US006323471B1

(12) United States Patent
Yagi

(10) Patent No.: US 6,323,471 B1
(45) Date of Patent: Nov. 27, 2001

(54) MICROWAVE AND FAR INFRARED HEATING UNDER REDUCED PRESSURE

(76) Inventor: Shunichi Yagi, 2-5-19 Shida, Fujieda-shi, Shizuoka-ken 426-0071 (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,926

(22) Filed: Mar. 1, 1999

(30) Foreign Application Priority Data

Nov. 25, 1998 (JP) ..... 10-334591

(51) Int. Cl.[7] ..... H05B 6/80

(52) U.S. Cl. ..... 219/680; 219/685; 219/686; 219/756; 219/763

(58) Field of Search ..... 219/762, 763, 219/686, 680, 685, 725, 732, 756, 734, 729

(56) References Cited

U.S. PATENT DOCUMENTS

| | | | | |
|---|---|---|---|---|
| 4,140,887 | * | 2/1979 | Sutton et al. | 219/762 |
| 4,179,596 | * | 12/1979 | Bjork | 219/686 |
| 4,343,978 | * | 8/1982 | Kubiatowicz | 219/732 |
| 4,963,709 | * | 10/1990 | Kimrey, Jr. | 219/686 |
| 5,066,843 | * | 11/1991 | Revesz | 219/762 |
| 5,223,685 | * | 6/1993 | DeRienzo, Jr. | 219/732 |
| 5,230,914 | * | 7/1993 | Akervik | 219/729 |
| 5,290,575 | * | 3/1994 | Torikata | 219/685 |
| 5,961,872 | * | 10/1999 | Simon et al. | 219/734 |

FOREIGN PATENT DOCUMENTS 2 746 910 * 10/1997 (FR) .

* cited by examiner

*Primary Examiner*—Philip H. Leung
(74) *Attorney, Agent, or Firm*—Hedman & Costigan, P.C.

(57) ABSTRACT

Microwave and far infrared heating under reduced pressure is carried out on objects to be dried, concentrated, defrosted, roasted or sterilized by placing the objects in plate-shaped or tray-shaped object-holding jigs arranged on a shelf-type jig which is held motionless in a pressure reducing chamber during heating, wherein the provision of reflector plates, reflective frames, specific object-holding jigs and cutting methods are employed to achieve uniform heating.

1 Claim, 12 Drawing Sheets

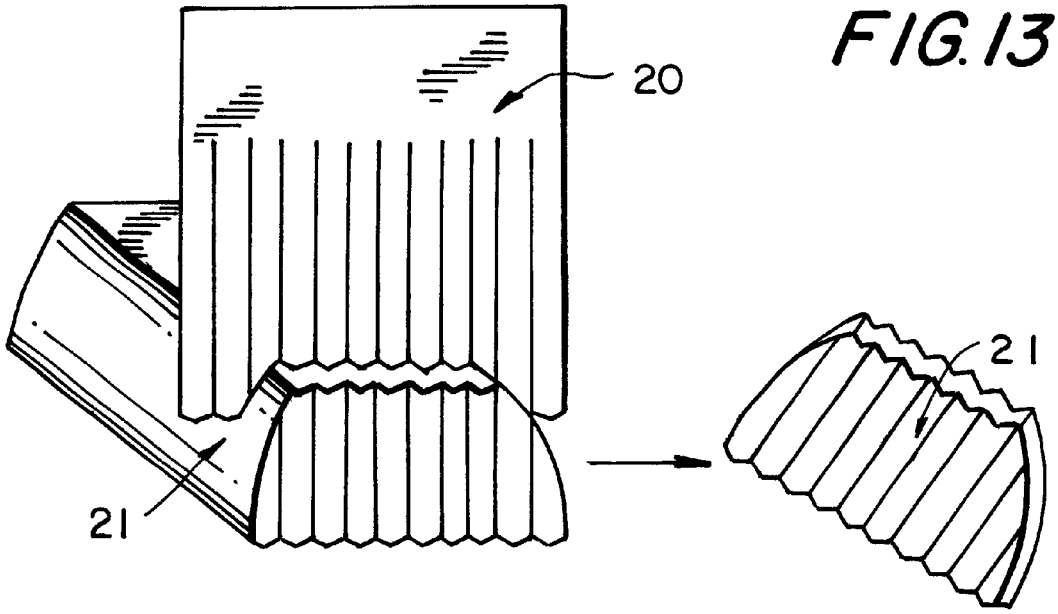
FIG. 13
FIG. 14
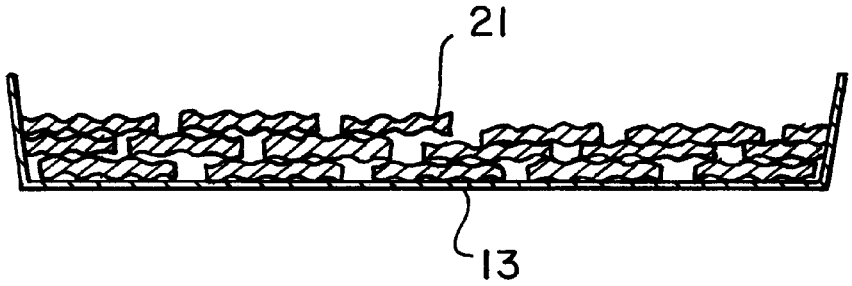

MICROWAVE AND FAR INFRARED HEATING UNDER REDUCED PRESSURE

BACKGROUND OF THE INVENTION

1. Field of the Invention

The present invention relates to a method and apparatus for heating objects using microwave and far infrared radiation under reduced pressure for the purpose of drying, concentrating, defrosting, roasting or sterilizing the objects.

2. Description of the Prior Art

In prior art heaters which utilize microwave and far infrared radiation for drying, concentrating, defrosting, roasting or sterilizing objects, uniform heating is achieved by placing the objects in a chamber on jigs such as plates or trays and shelf-type support jig for supporting the jigs which is rotated or on a conveyor which is moved, or the objects are stirred.

However, prior art heaters having a rotatable jig for rotating objects to be heated are expensive and not suited for mass production due to the limited amount of objects that can be supported by the rotatable jig. Further, the scattering of powder and relatively light particles occurs in prior art heaters which stir objects to be dried, and because such heaters are complex and expensive, they are not preferred. Further, prior art heaters which move objects on a conveyor are quite suited for continuous production, but control of this type of heater is difficult. Namely, because objects are continuously supplied, a mixture of objects having different water contents is created, and because this makes it difficult to accurately detect the completion of heating, a high production efficiency can not be achieved. Further, because the accuracy in detecting the completion of heating is lowered, a control data base is required for each object when objects having different water contents are supplied at the time of each production, and this makes the control process extremely complicated. Furthermore, such heating apparatuses are large in scale, and this together with the lower level of accuracy requires much time and cost to obtain conforming articles. For the reasons given above, the use of heaters utilizing microwave and far infrared radiation under reduced pressure has not been widespread.

SUMMARY OF THE INVENTION

It is an object of the present invention to solve the problems described above. First, in the present invention, the objects to be dried, concentrated, defrosted, roasted or sterilized are held in plate-shaped or tray-shaped object-holding jigs stacked on a shelf-type support jig which is placed at a prescribed position in a pressure reducing chamber to heat the objects under reduced pressure, and this eliminates the problem of low productivity caused by the use of rotatable jigs and the like. Further, because the object-holding jigs are held still during processing, a large quantity of objects can be placed on the plate-shaped or tray-shaped object-holding jigs outside the pressure reducing chamber and then such plate-shaped or tray-shaped object-holding jigs can be loaded on the shelf-type support jig, and if all these are loaded using a lifter device or the like, it becomes easy to supply the pressure reducing chamber with a large quantity of objects. Furthermore, because the objects are held still instead of being agitated or the like, the present invention avoids making the heating apparatus complicated and prevents scattering inside the pressure reducing chamber. At this point, it should be mentioned that up to now it has been difficult to obtain uniform microwave heating and far infrared heating when the objects are not moved such as by rotation or agitation.

Further, prior art apparatuses and methods that continuously supply objects by moving them on top of a belt conveyor are suited for continuous production, but such arrangement makes it difficult to sufficiently control heating. Namely, for continuous production to work with such prior art arrangement, the objects must be supplied and removed in order, and because this normally causes the immediately supplied objects having a high water content to mix with the objects that are near the completion of heating and have a low water content, the balance between the quantity of water vapor created and the quantity of exhaust removed by the vacuum pump does not obey a fixed law, and this leads to an irregular change in the reduced pressure level, which in turn makes it impossible to confirm the change in the reduced pressure level and the amount of change in the reduced pressure level in order to carry out high precision heating control. However, by the means described in the appended Claims, heat control in the present invention is carried out for individual batches of large quantities of objects to be dried, concentrated, defrosted, roasted or sterilized, and because all the objects in a single batch have roughly the same water content and are arranged at a prescribed position within the pressure reducing chamber, the change in the reduced pressure level and the amount of change in the reduced pressure level can be confirmed to obey a fixed law, and this makes it possible to carry out high precision heating control.

Now, in the embodiments of the present invention described in, the objects to be dried, concentrated, defrosted, roasted or sterilized are loaded on non-rotating plate-shaped or tray-shaped object-holding jigs stacked on a non-rotating shelf-type support jig placed at a prescribed position within the pressure reducing chamber, and because the objects are not agitated, there is no need for a rotation axle, whereby it becomes possible to reduce space loss, achieve a sufficient microwave depth penetration and significantly increase the surface area and holding capacity of the objects. Furthermore, the use of a lifting device makes it possible to easily and quickly load the object-holding jigs into the pressure reducing chamber, and because this speeds up the overall processing time, the use of a lifting device with the present invention is suited for mass production. Moreover, because the objects are not agitated, the present invention prevents the scattering of objects inside the pressure reducing chamber, and because this soiling of the inside of the pressure reducing chamber, the present invention makes it possible to improve maintenance and controllability. Further, the present invention is suited to achieve a high precision, uniform heating even when the objects are heated while held in place at a prescribed position instead of being moved on a conveyor or the like. Namely, in order to carry out a high precision control of heating, it is necessary to obtain the change in the reduced pressure level based on the balance of the water vapor content and the amount of exhaust of the vacuum pump, or the change in the water content of such exhaust, but in continuous supply methods such as the conveyor method in which objects having a high water content are continuously supplied, the objects that have just been supplied but not yet heated mix with objects that are near the completion of heating, and for this reason such systems do not display changes in the reduced pressure level according to a prescribed law, and this makes it difficult to obtain either the change in the reduced pressure level or the change in the water content of the exhaust to be used for control purposes. However, in the present invention, because only objects having roughly the same water content are present in the pressure reducing chamber, the balance between the amount of water vapor created and the amount of exhaust of the vacuum pump can be measured in accordance with a prescribed law, and this makes it possible to confirm that the change in the reduced pressure level and the amount of change in the reduced pressure level obey a prescribed law. Further, in the case where the amount of water vapor is measured, an extremely precise measurement of the increase thereof can be taken, and this makes it possible for the present invention to carry out high precision dryness level detection.

In one embodiment, the heating apparatus is provided with a shelf-type support jig having reflector plates arranged at the top and bottom surfaces thereof, and in this way the objects on the top and bottom shelves and the objects on the shelves therebetween can be made to undergo microwave heating and far infrared heating at roughly the same power level. In this connection, the prescribed distance from the reflector plates to the plate-shaped or tray-shaped object-holding jigs and whether the entire surface of the reflector plates or only a portion thereof will be made reflective, is adjusted in accordance with the incidence positions of the microwave radiation and far infrared radiation.

Further, by arranging reflector plates on the sides of the shelf-type support jig, or by arranging reflector plates at horizontal positions at each shelf of the shelf-type support jig, the area heated by the microwave radiation and far infrared radiation can be averaged out. In this regard, without the provision of these reflector plates, heating begins from those positions nearest the microwave and far infrared emission sources, but with the provision of such reflector plates, heating is also carried out simultaneously at positions far from the microwave and far infrared emission sources, and in this way uniform heating is carried out. Further, the position, number and surface area of such reflector plates is adjusted in accordance with the incidence positions of the microwave radiation and far infrared radiation.

In another embodiment, the upper portion of each of the plated-shaped or tray-shaped object-holding jigs is provided with a reflector frame. This makes it possible for the microwave radiation and far infrared radiation to heat the peripheral portions and central portions simultaneously, thereby achieving uniform microwave and far infrared heating of the objects. In this regard the size of such reflector frames is adjusted in accordance with the size of plate-shaped or tray-shaped object-holding jigs and the type of objects to be heated.

In another embodiment the upper portion of each of the plate-shaped or tray-shaped object-holding jigs is provided with a reflector frame. This makes it possible for the microwave radiation and far infrared radiation to heat the peripheral portions and central portions simultaneously, thereby achieving uniform microwave and far infrared heating of the objects. In this regard, the size of such reflector frames is adjusted in accordance with the size of plate-shaped or tray-shaped object-holding jigs and the type of objects to be heated.

Further, in the case where the shelf-type support jig is made of metal such as stainless steel or the like, if the end portions of the shelf-type support jig are too close to or come in contact with the walls inside the pressure reducing chamber, microwave radiation can cause discharges. In response to this type of problem, heat-resistant blocks made of a microwave permeable substance such as fluororesin are arranged between the leg bottom of the shelf-type support jig and the walls inside the pressure reducing chamber. In general, these blocks will prevent discharges if they have a thickness of 10 mm or greater, and the particular thickness may be selected in accordance with the apparatus used.

In another embodiment, uniform heating is achieved by providing the center of the bottom surface of each plate-shaped or tray-shaped object-holding jig with a bulging portion to make the thickness of the portion of objects supported above the central portion, which is the last portion heated by the microwave radiation, relatively thinner than the portion of objects supported by the portion of the bottom surface surrounding the bulging portion in order to balance the heating of the central portion and surrounding portion of the objects. In this regard, the height and surface area of the bulging portion is adjusted in accordance with the type of objects.

In the object-holding jigs are made from materials and given prescribed shapes to enable uniform microwave heating to be carried out. First, because water is vaporized as it passes through the top portion of the objects, the top portion is given an open shape to allow the water present in the top portion of the objects to receive sufficient far infrared heating, and to uniformly heat the entire periphery of the objects, the object-holding jigs are made of a resin that is permeable to microwave radiation and resistant to microwave and far infrared heating. As a result of experiments, it has been determined that the resin used for such purposes should have a heat deformation resistance temperature (i.e., the temperature below which the resin will not deform) roughly above 160° C., and examples of specific resins that can be used include polysulfone (PSF), polyethersulfone (PESF), fluororesin (PTEF) and silicon resin (SI).

Now, because the resins are generally expensive, another embodiment uses object-holding jigs made of paper. In this connection, although paper has a low permeability, it is a material having sufficient resistance to enable it to be used in the heating apparatus according to the present invention. Further, the apparatus has paper object-holding jigs in which a coating or coated paper is provided on the surfaces of the object-holding jigs that come into contact with the objects in order to prevent the objects from sticking to such surfaces and thereby becoming difficult to remove.

The heating apparatus is provided with object-holding jigs having a plurality of holes formed in the side and bottom surfaces thereof to enable the objects to receive sufficient microwave heating even when the object-holding jigs have high walls. In addition to improving microwave permeability in the case where paper object-holding jigs are used, this embodiment makes it possible to process objects requiring a large holding volume.

Now, in case where square or rectangular object-holding jigs are used, it has been found that the objects present in the corner portions of such object-holding jigs receive more microwave radiation than the objects present in the central portion thereof, and for this reason it is easy for the objects in the central portion to receive an insufficient amount of heating compared to the amount of heating received by the objects in the corner portions. To solve this problem, the corner portions are eliminated by using circular or oval object-holding jigs to achieve uniform microwave heating.

Further, an even higher precision control can be achieved by preventing the scattering of objects inside the pressure reducing chamber due to water vapor emission and the like. To achieve such level of control and at the same time maintain clean conditions in the pressure reducing chamber, apparatus uses paper members to cover the tops of the plate-shaped or tray-shaped object-holding jigs, and even though paper is not highly permeable to microwave radiation, the permeability possessed by paper is sufficient to enable uniform microwave heating.

Now, in case where solid objects are to be cut into smaller objects, if the smaller objects are produced with flat cut surfaces, the cut surface of one cut object will be in flush contact with the cut surface of another cut object if the cut objects are stacked together, and for this reason it will not be possible for microwave radiation to reach such cut surfaces, thus creating a hindrance to uniform heating. To prevent this problem, the solid objects are cut so as to form waveform-shaped cut surfaces that enable air to pass through the cut objects and microwave radiation to uniformly reach the cut surfaces when the cut objects are stacked together during heating, and this makes it possible to uniformly heat the cut surfaces with microwave radiation.

Now, by using the embodiments of the present invention, it is possible to achieve the following results:

(1) Because the objects being heated are held in object-holding jigs that are not rotated, a plurality of object-holding jigs can be stacked on a shelf-type support jig to enable much more objects to be dried, and for this reason the present invention finds immediate application to industrial production. Further, because there is no need for a rotational driving portion, the complexity and cost of the heating apparatus is reduced.

(2) Because the objects are not mechanically agitated or moved during heating inside the pressure reducing chamber, the present invention makes it possible to prevent scattering of the objects, and this in turn has the effect of making it possible to maintain a clean environment inside the pressure reducing chamber under normal conditions, whereby it becomes possible to carry out a continuous high precision control of the heating operations.

(3) Because the objects are held motionless and are not mechanically moved into or out of the pressure reducing chamber during the heating process, there is no need for a drive portion such as a conveyor and motor which can break down, and in this way the present invention makes it possible to construct a low-cost heating apparatus. Further, in comparison with the large-scale prior art heating apparatuses which use such a conveyor system, the present invention makes it possible to construct a relatively compact heating apparatus suitable for mass production.

(4) By achieving a high precision control not attainable with prior art apparatuses which use a continuous feed conveyor system, the present invention makes it possible to mass produce high-precision processed goods in a relatively short period of time.

(5) Up to now, the use of drying devices which utilize microwave radiation has not been widespread mainly due to the fact that, in addition to being expensive, such devices do not provide uniform heating and can not be used in mass production. However, as explained above, the present invention solves these problems.

(6) When using high quality "clean"microwave radiation from a microwave emission source that is activated at the moment when electric current begins to flow and deactivated at the moment when electric current is cut off, the diffusion of such microwave radiation should be extremely effective, and this is effect is achieved by the present invention.

BRIEF DESCRIPTION OF THE DRAWINGS

FIG. 13 is an explanatory drawing used in explaining the method of cutting solid objects in accordance with the present invention.

FIG. 14 is an explanatory drawing showing how the objects cut in accordance with the present invention are stacked in a tray.

DETAILED DESCRIPTION OF THE PREFERRED EMBODIMENTS

Specific example embodiments will now be described below with reference to the appended drawings.

EXAMPLE EMBODIMENT 1

Figure 1:
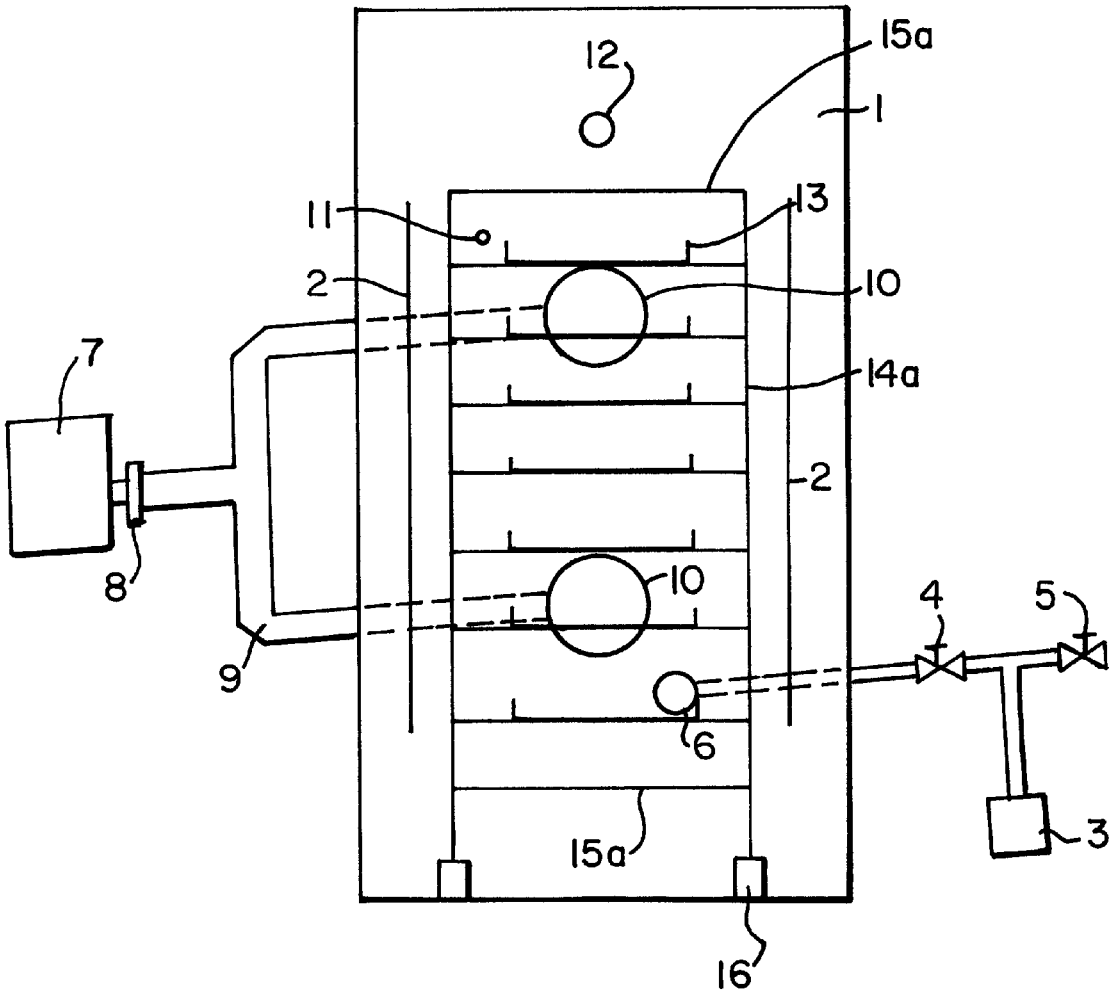
FIG. 1 is a schematic view showing one embodiment of the present invention.
Figure 2:
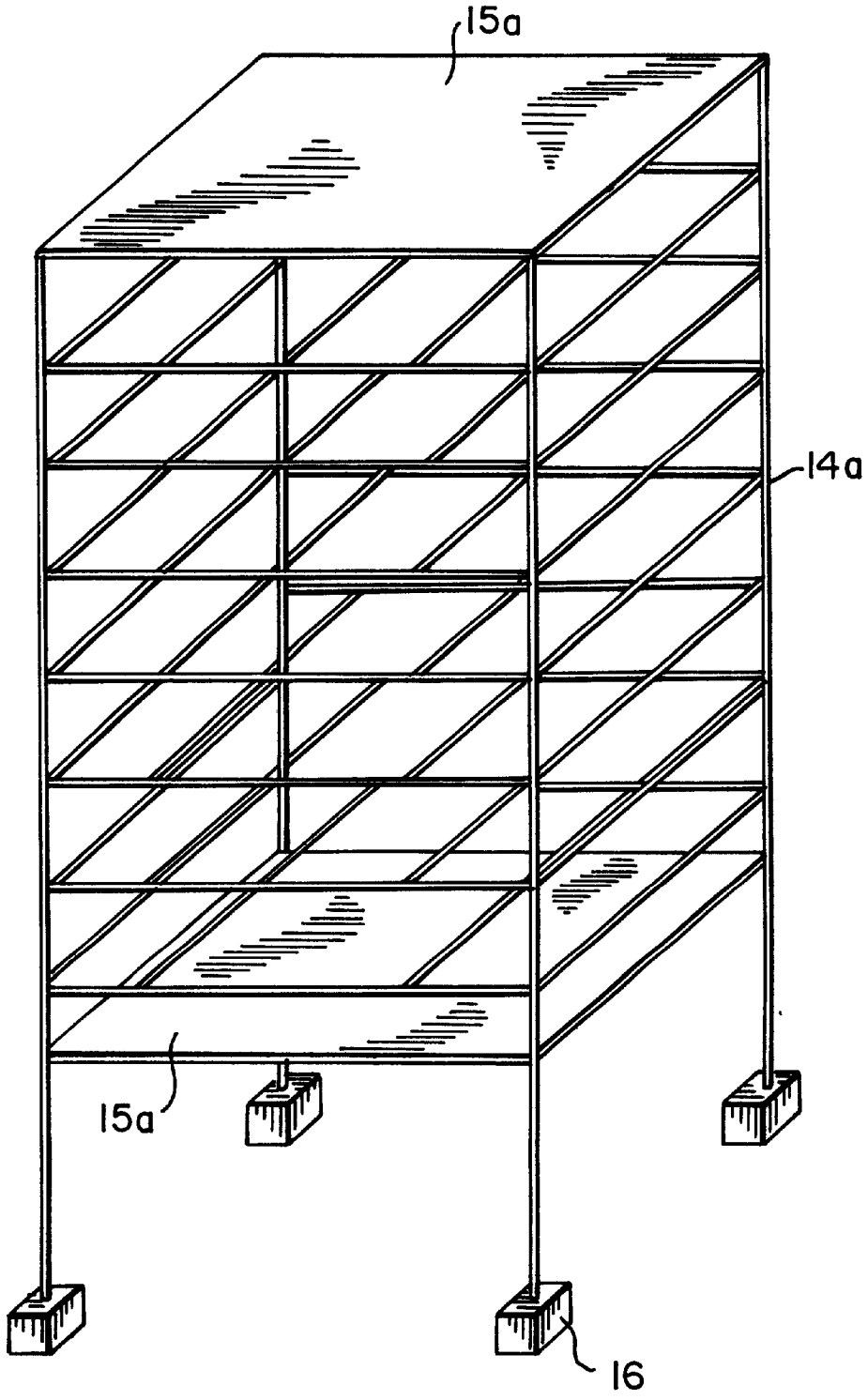
FIG. 2 is a perspective view of one embodiment of the present invention in which metal reflector plates are provided above and below a shelf-type support jig.
Figure 3:
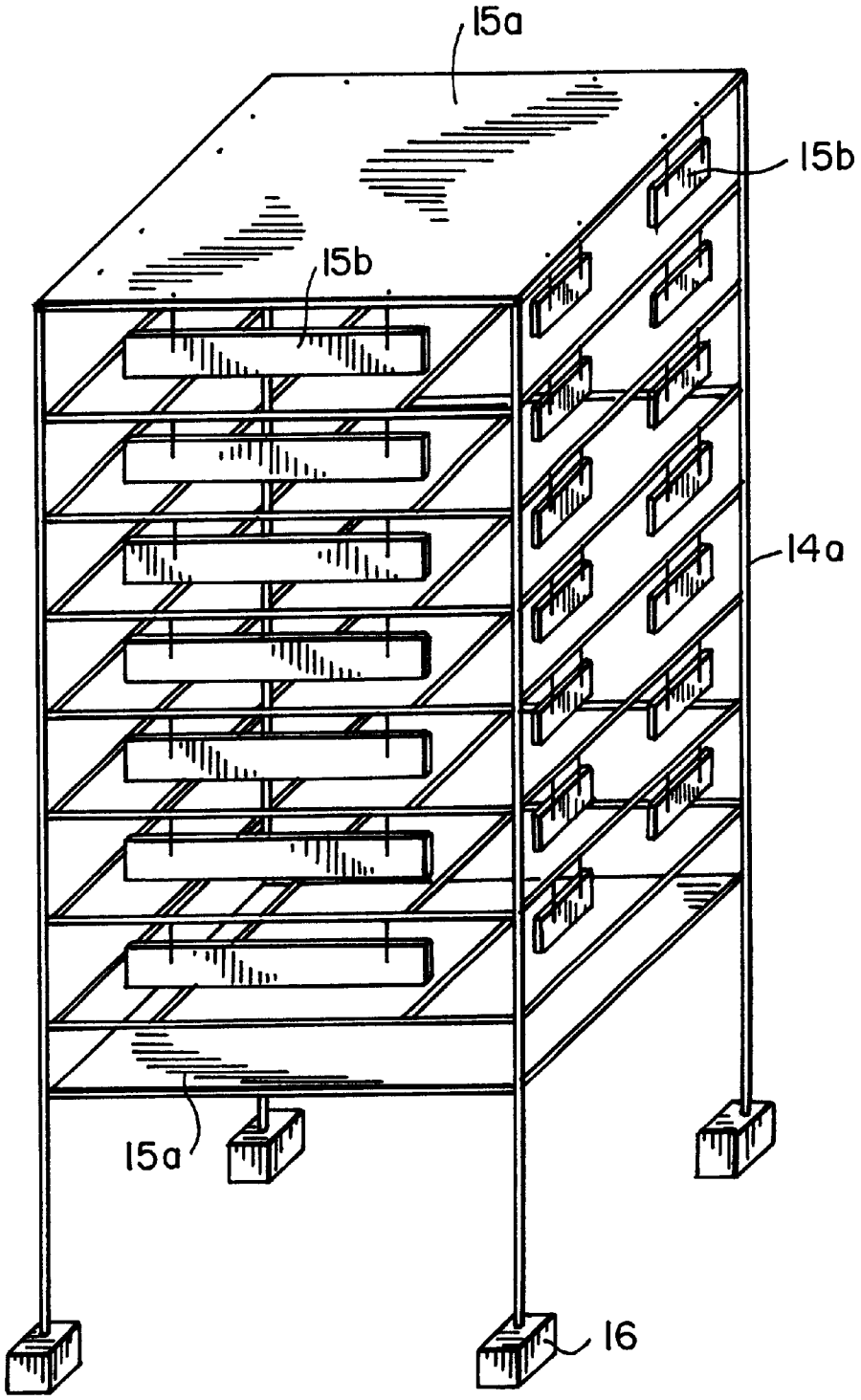
FIG. 3 is a perspective view of one embodiment of the present invention in which metal reflector plates are also provided on the sides of the shelf-type support jig.
Figure 4:
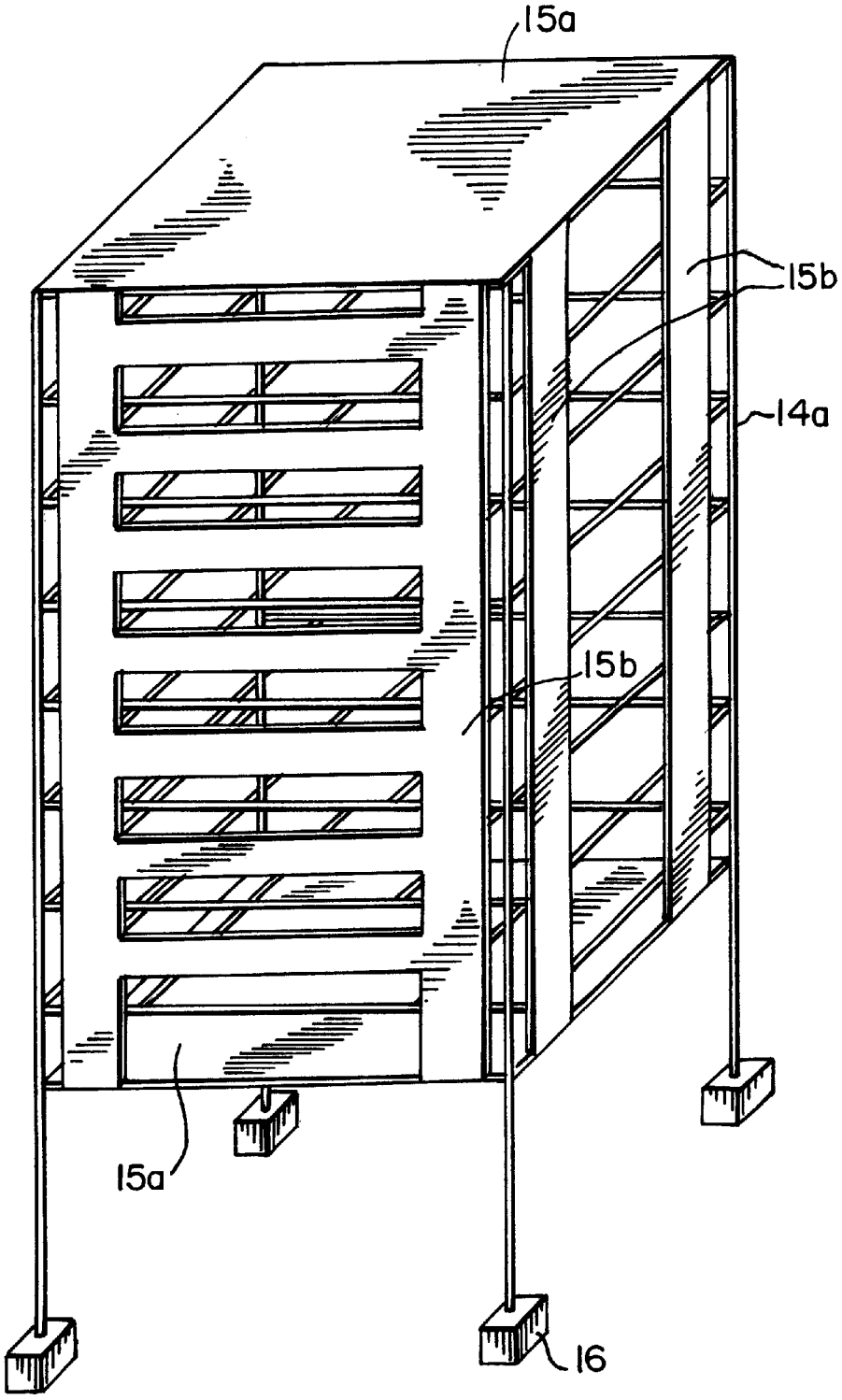
FIG. 4 is a perspective view of another embodiment of the present invention in which metal reflector plates are also provided on the sides of the shelf-type support jig.
Figure 5:
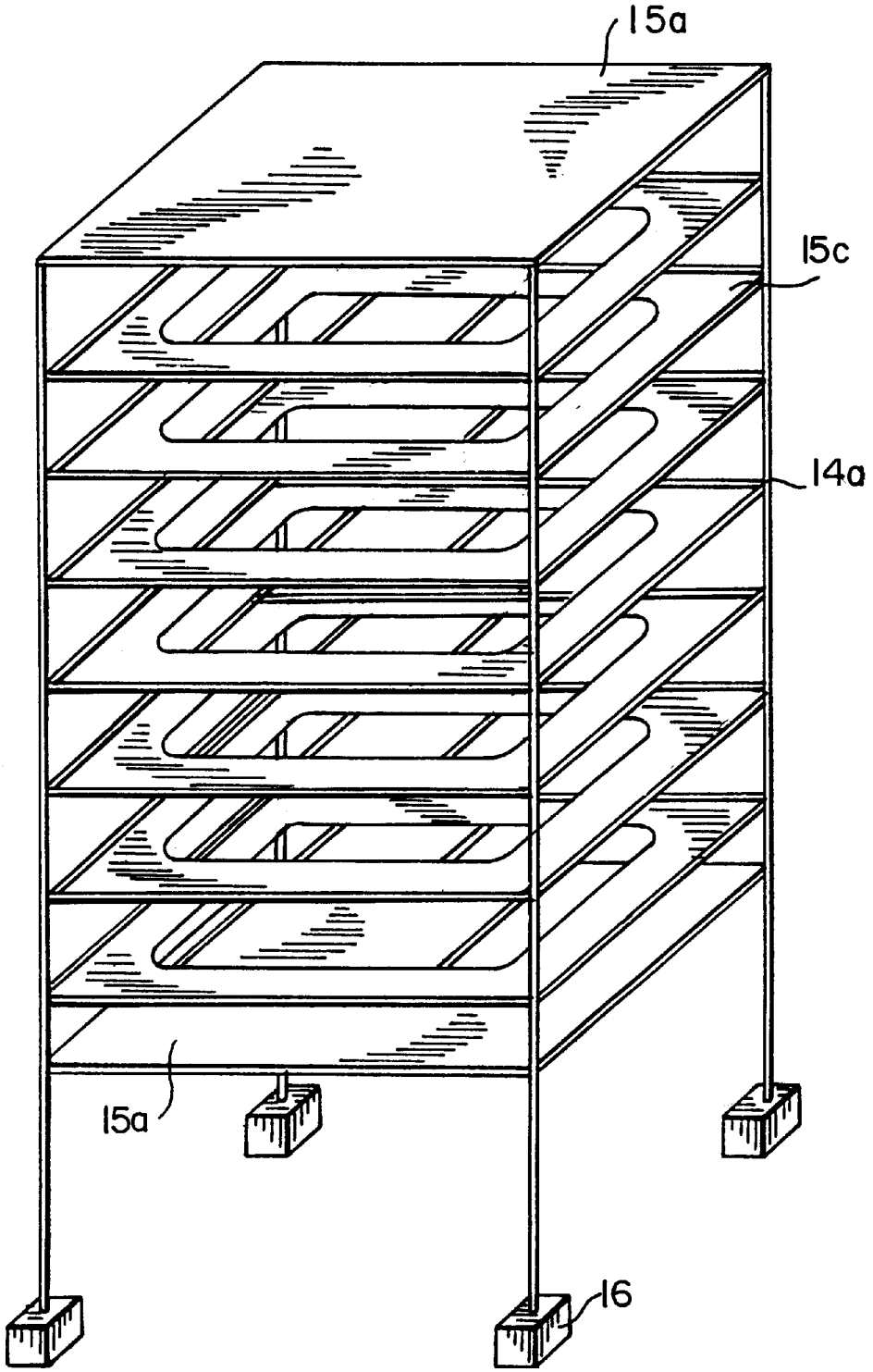
FIG. 5 is a perspective view of one embodiment of the present invention in which metal reflector plates are provided at each shelf of the shelf-type support jig.
Figure 6:
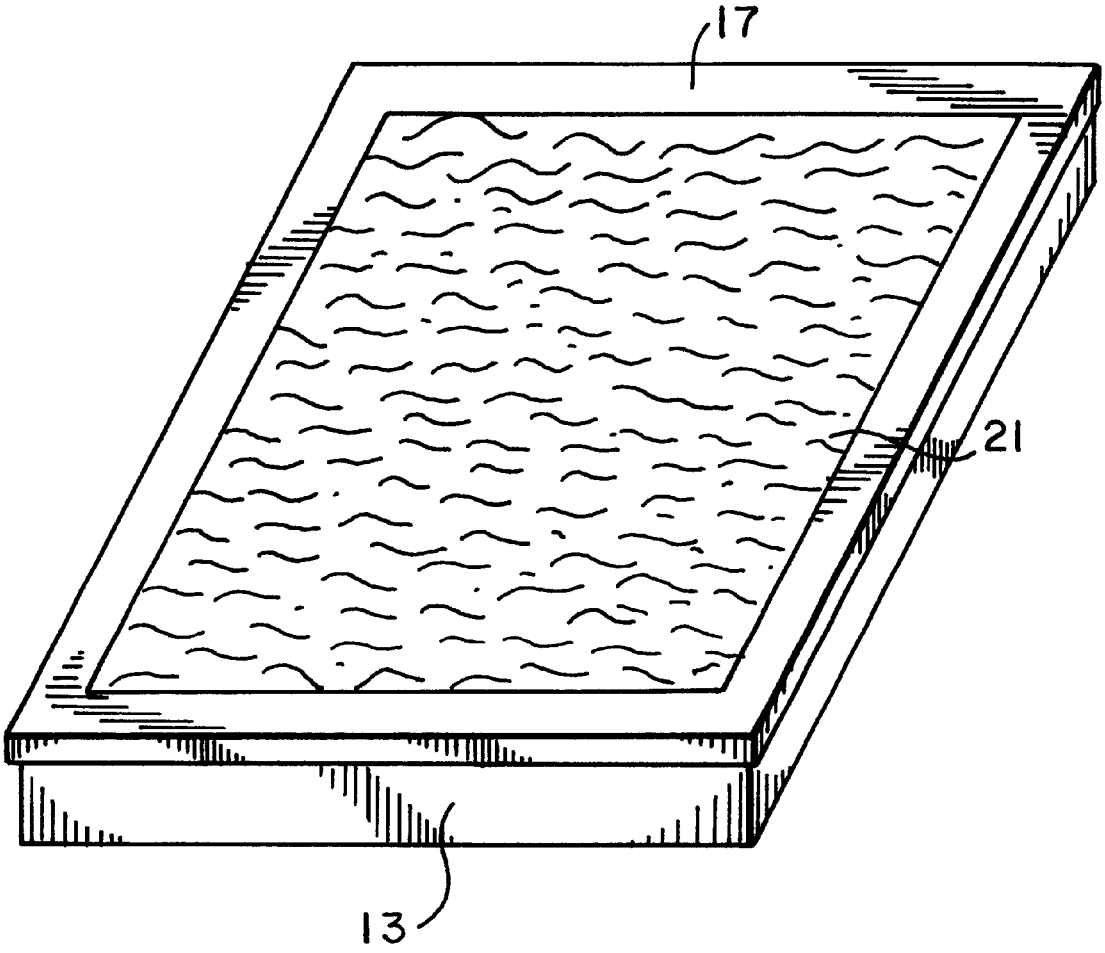
FIG. 6 is a perspective view of a reflective frame provided on the top portion of a tray according to an embodiment of the present invention.
Figure 7:
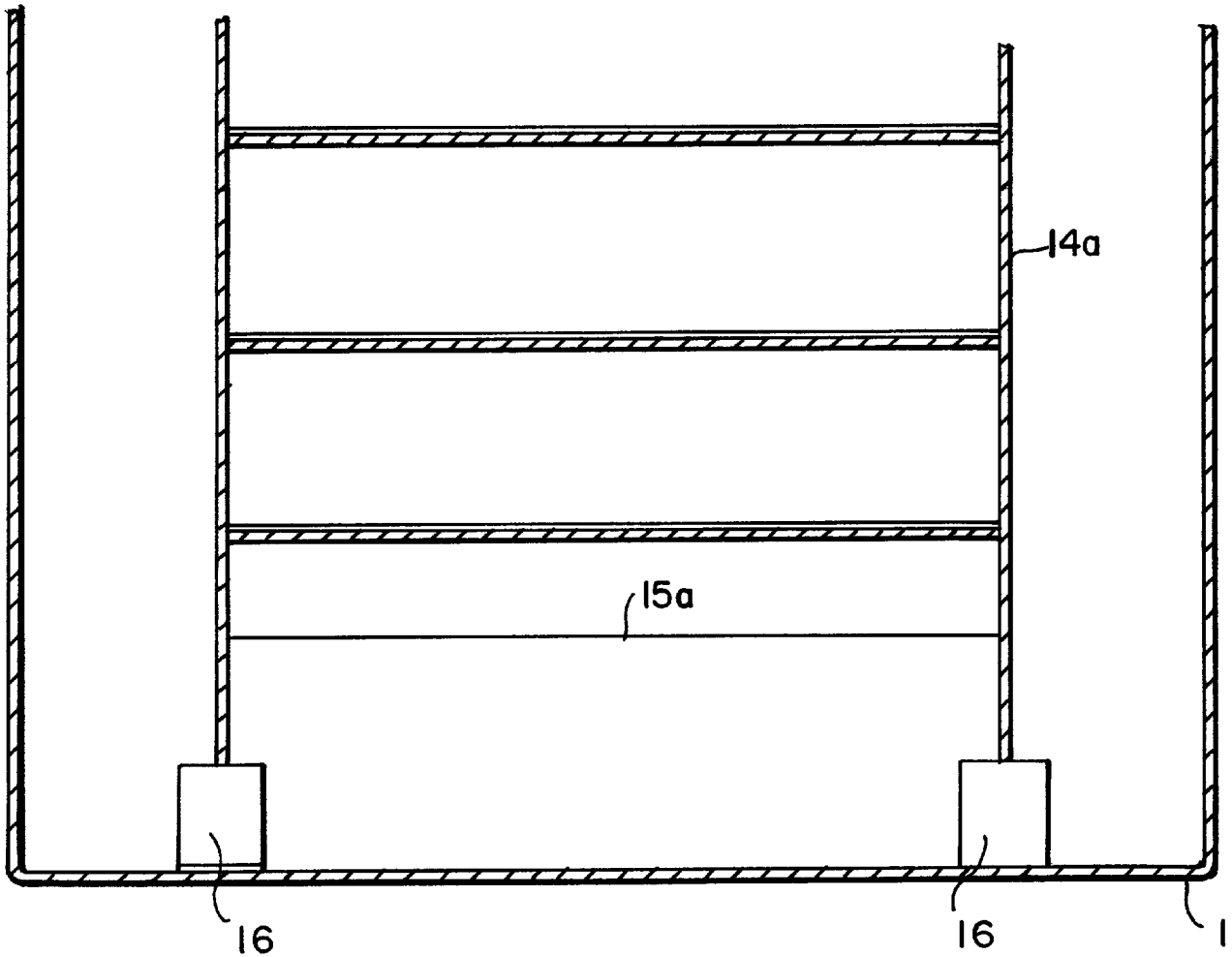
FIG. 7 is a cross-sectional view showing the structure of a jig according to the present invention arranged inside a pressure reducing chamber.
Figure 8:
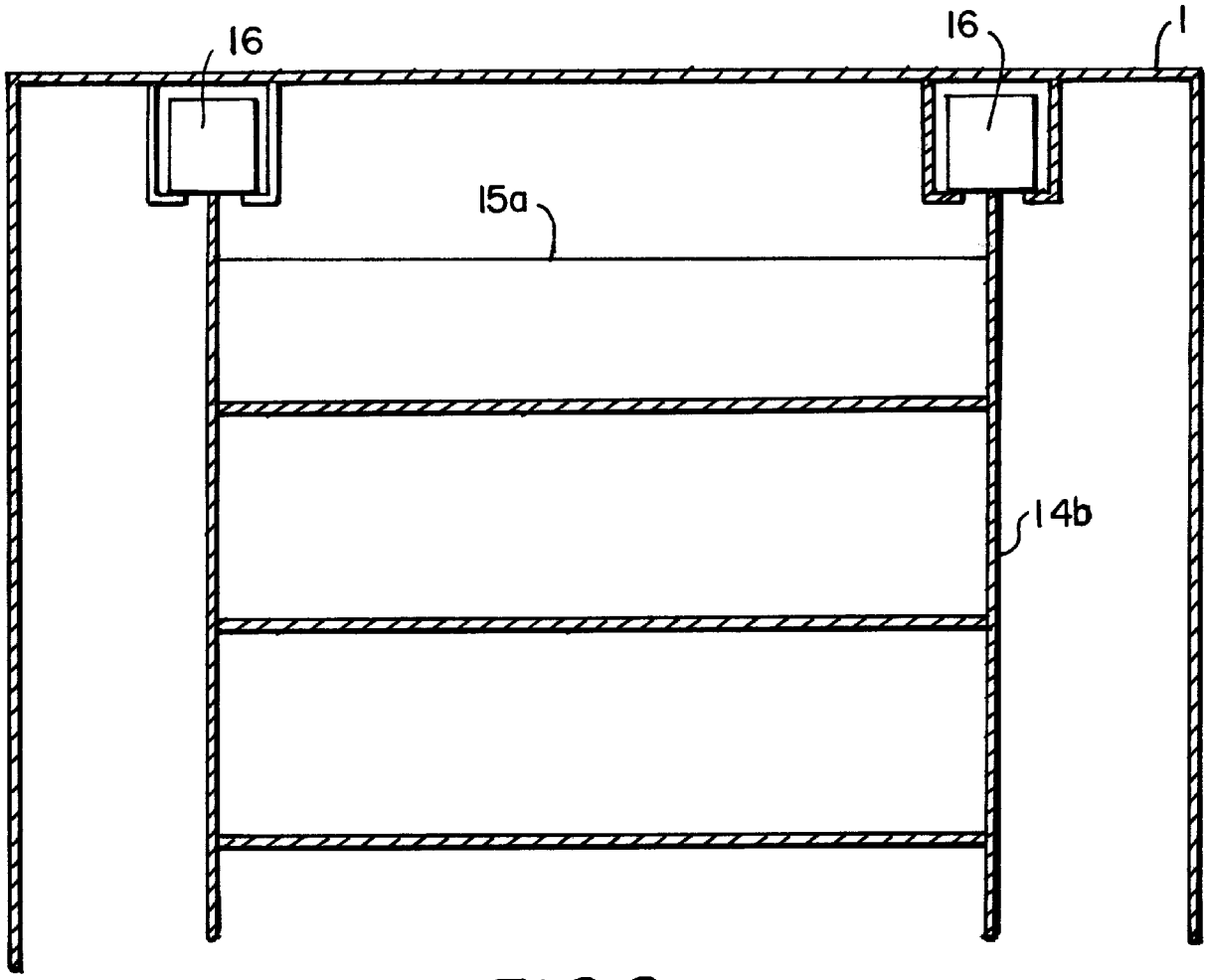
FIG. 8 is a cross-sectional view showing a suspension type support jig according to the present invention arranged inside a pressure reducing chamber.
Figure 9A:
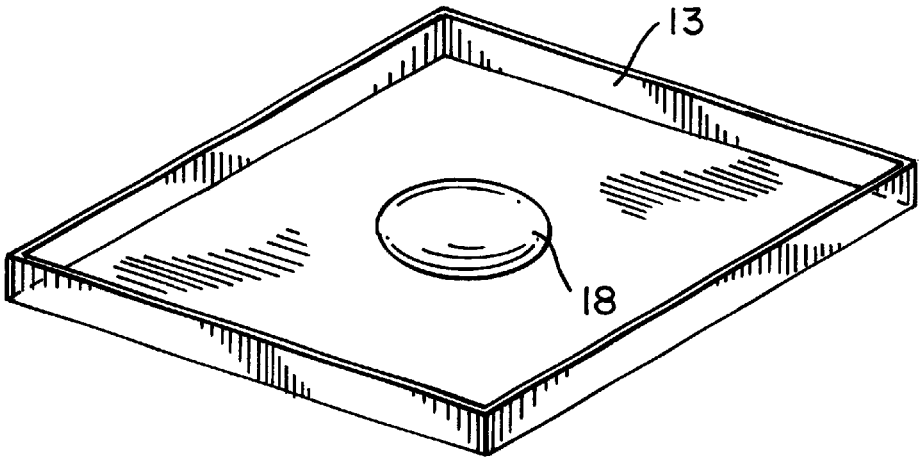
FIG. 9(*a*) is a perspective view showing the bulging portion provided in the center of a tray according to the present invention, and FIG. 9(*b*) is a cross-sectional view thereof.
Figure 9B:
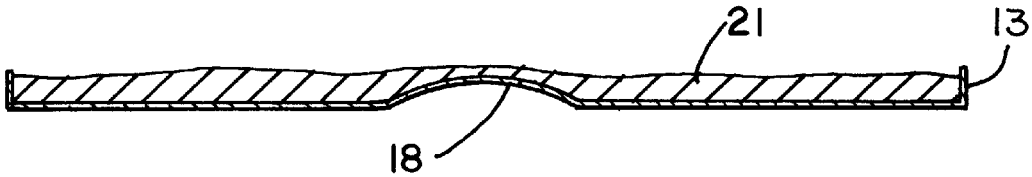
Figure 10:
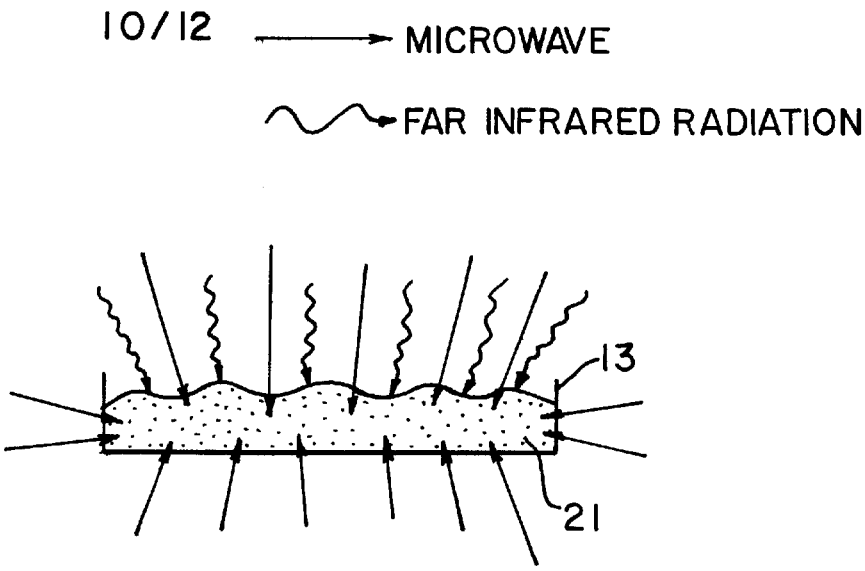
FIG. 10 is an explanatory drawing used to show the incidence of microwave and far infrared radiation on objects held in a tray according to the present invention.
Figure 11:
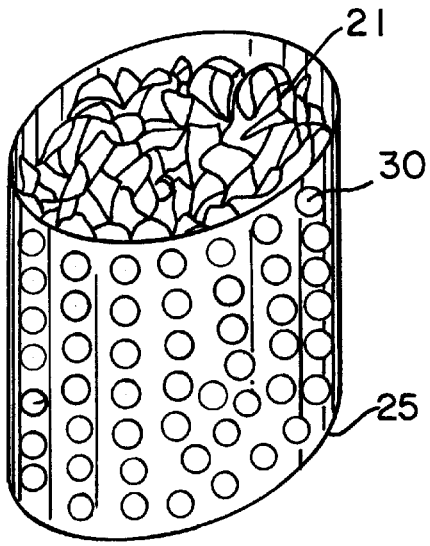
FIG. 11 is a perspective view showing a circular basket provided with a plurality of holes made in accordance with the present invention.
Figure 12:
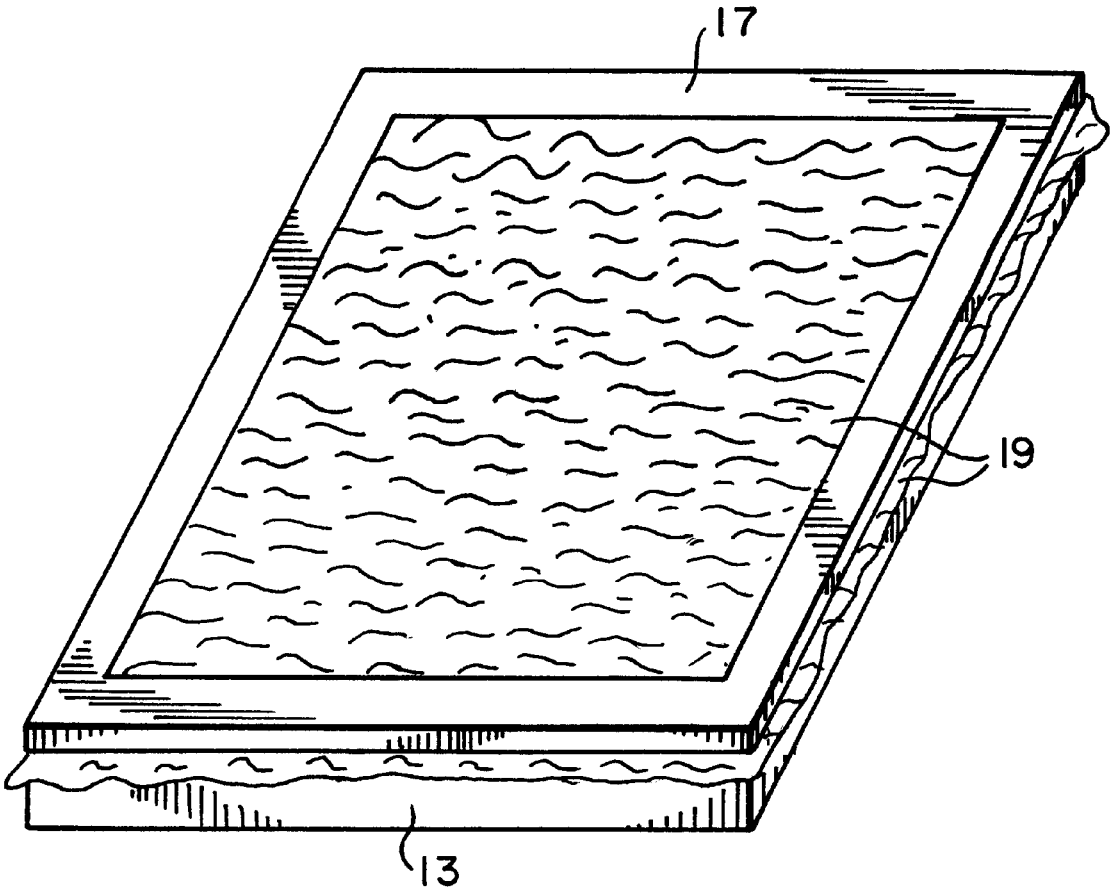
FIG. 12 is a perspective view showing the use of a paper material to cover a tray used in the present invention.

A heating apparatus was constructed from a 5 kW output microwave generator 7, a 4 kW far infrared heater 2, a pressure reducing chamber 1, a 5 kW vacuum pump 3, a shelf-type support jig 14*a* and 20 mm-thick, heat-resistant, microwave-permeable blocks 16 provided between the bottom tip portions of the legs of the support jig 14*a* and the upper surface of the bottom of the pressure reducing chamber 1 in order to prevent microwave-induced discharges. Vacuum pump 3 is connected to pressure reduction opening 6 through pipe, and pressure reducing valve 4 and reduced-pressure level regulating valve 5 are provided on the pipe. In FIG. 1, 8 is an isolator and 9 is a wave guide. In FIG. 1~FIG. 14, 11 is a thermopile for far infrared heating, 12 is a pressure opening, 13 is trays for holding objects to be dried, concentrated, defrosted, roasted or sterilized. 15(*a*) is top and bottom reflector plates, 15(*b*) is side reflector plates, 15(*c*) is shelf-reflector plates provided at each shelf. 16 is heat-resistant, microwave-permeable insulating block to prevent discharges. The shelf-type support jig 14*a* has a height of one meter and includes seven horizontal shelves that are square-shaped with 45 cm sides.

First, a test to measure the rise in temperature of water placed in beakers was carried out with no reflector plates arranged on the shelf-type support jig. Namely, one beaker containing 80 cc of water was placed at each of the four corners and in the middle of each shelf for a total of 2800 cc of water contained in 35 separate beakers. In this test, the starting temperature of the water in each beaker was 20° C. and heating was carried out for 2 minutes with the output of the microwave generator 7 at 5 kW and the output of the far infrared heater 2 controlled by PID, after which the temperature of the water in each beaker was measured three times, with the average value thereof being used to determine the increase in temperature. As a result, it was found that the greatest increase in water temperature occurred in the beakers on the bottom shelf near the microwave input opening 10, which had a temperature of 82° C., and in the beakers on the top shelf near the microwave input opening 10, which had a temperature of 81° C., while the lowest temperature increase occurred in the central beaker on the middle shelf (i.e., the fourth shelf), which had a temperature of 52° C. Accordingly, the roughly 30° C. temperature difference observed in this test confirmed that the heating was not uniform.

Next, a structure was created by mounting horizontal stainless steel reflector plates 15*a* to the shelf-type support jig 14*a* which provides trays or plates 13 at positions 100 mm above the top shelf and below the bottom shelf over the entire surfaces thereof, and then the same test was carried out. As a result, it was once again found that the greatest increase in water temperature occurred in the beakers on the bottom shelf near the microwave input opening 10, which had a temperature of 73° C., and in the beakers on the top shelf near the microwave input opening 10, which had a temperature of 71° C., while the lowest temperature increase occurred in the central beaker on the middle shelf (i.e., the fourth shelf), which had a temperature of 63° C. Thus, the addition of the reflector plates was observed to create a vast improvement, although there is still a temperature difference of about 10° C.

Next, a structure was created by mounting rectangular stainless steel reflector plates 15*b* to the sides of the shelf-type support jig 14*a* near the beakers that were heated the most, with the stainless steel reflector plates and the shelf-type support jig spaced so as to not induce microwave discharge, and then the same test was carried out while measuring the temperature distribution. As a result, it was found that the greatest increase in water temperature occurred in the beakers on the shelf second from the top near the microwave input opening 10, which had a temperature of 66° C., and in the beakers on the shelf second from the bottom near the microwave input opening 10, which had a temperature of 65° C., while the lowest temperature increase occurred in the central beaker on the middle shelf (i.e., the fourth shelf), which had a temperature of 60° C. Thus, a temperature difference of only 5° C. was observed, and this difference is low enough to consider uniform heating to have taken place.

Next, was created by mounting 30 mm-wide stainless steel reflector plates at each shelf of the shelf-type jig at horizontal positions along the periphery thereof, and then the same test was carried out. As a result, it was found that the greatest increase in water temperature occurred in the central beaker on the shelf second from the top, which had a temperature of 64° C., and in the central beaker on the shelf second from the bottom, which had a temperature of 63° C., while the lowest temperature increase occurred in the beakers on the fourth shelf near the microwave input opening 10, which had a temperature of 60° C. Thus, a temperature difference of only 4° C. was observed, and this difference is clearly low enough to consider uniform heating to have taken place.

Next, a structure was created by placing the beakers in trays loaded on each shelf of the shelf-type support jig and providing the upper portion of the trays with a 10 mm-wide, angled stainless steel reflector frame, and then the same test was carried out. As a result, it was found that the temperature difference between the beakers was within 2° C., and this is considered to be a high level of uniform heating.

Next, the beakers were replaced by wet towels, the vacuum pump 3 was engaged, and heating was carried out. During such heating, no discharge was detected at the legs of the shelf-type support jig 14*a* due to the use heat-resistant, microwave-permeable insulating blocks 16 to prevent discharges. Further, no discharge was detected in the case where a hanging shelf-type support jig 14*b* (see FIG. 8) was used due to the use of heat-resistant, microwave-permeable insulating blocks 16 to prevent discharges at the upper side.

EXAMPLE EMBODIMENT 2

Next, using the structure described in Example Embodiment 1 a test of the effectiveness of a structure built in accordance with the embodiment described in claim 8 was carried out by drying 7 kg of seasoning paste. First, using a flat bottom tray, the paste was filled to a horizontal level, and then drying was carried out. When the tray was being removed, it was discovered that the center portion was not completely dried, so a drying process was carried out again. After the second drying, the center portion was completely dried, but a portion of the surrounding area was burnt. Next, a dome-shaped center bulging portion; convex portion 18 formed in the tray bottom having a diameter of 80 mm and a height of 7 mm was formed in the center of a tray or plate 13 to create a structure and then after this tray was filled with 7 kg of seasoning paste to a horizontal level, a drying process was carried out. In this case, a complete uniform drying of the paste was confirmed. In this connection, if an automatic loading device were used to fill such trays with paste, it would be possible to construct an automated paste drying system.

EXAMPLE EMBODIMENT 3

Next, a test of the effectiveness of a structure where the object holding jigs are open shaped and are made of heat resistant and microwavable material was carried out by concentrating 7 kg of strawberries. First, the strawberries were loaded onto aluminum plates, and then drying was begun with a goal of removing 60% of the water content. However, because microwave radiation can not penetrate through the bottom surface of the aluminum plates, only 35% of the water content was removed within a prescribed drying time. Next, 7 kg of strawberries were loaded onto plates made of polysulfone, and after drying was carried out for the prescribed drying time, it was confirmed that roughly 60% of the water content had been removed. Further, when these dried strawberries were ground up, an extremely delicious paste was created.

EXAMPLE EMBODIMENT 4

Next, a concentration process for concentrating 7 kg of strawberries was carried out again for the case of a plate where the object-holding jigs are made from paper and the portions that come into contact with the objects are coated with a microwave permeable resin or covered with paper coated with a microwave permeable resin. Namely, after a 1 mm-thick cardboard plate was prepared and covered with a sheet of silicon-treated paper, the strawberries were loaded and drying was begun. After drying had been carried out over the prescribed drying time, measurements were taken, and the results showed that 55% of the water content had been removed. Further, even though a small quantity of the strawberries had rolled away, the provision of the sheet made it possible to smoothly pick up all the concentrated strawberries.

EXAMPLE EMBODIMENT 5

Next, a test of the effectiveness of a structure built with holes in the object jigs, where the holes are of a diameter small enough to prevent the objects from passing through said holes and the bottom surface of said object jigs have a circular or oval shape to enable uniform microwave heating, was carried out by drying 7 kg of sweet basil. First, a cube-shaped paper basket measuring 30 cm a side was loaded with the sweet basil and then drying was carried out. At the end of such drying, it was found that the stem portions of the basil leaves in the center of the cube-shaped paper basket had not been dried very much, and because a rather long drying time of 1 hour and 45 minutes was required, the dried product suffered a loss in taste quality. Next, 7 kg of sweet basil were dried in a 35 cm-diameter circular basket 25 constructed with a plurality of 15 mm-diameter holes 30 formed in the bottom and side surfaces thereof. Compared with the case of a cube-shaped basket having no holes, the drying time for the case of a circular basket provided with holes was much shorter at only 30 minutes, and the dried product maintained a high degree of taste quality.

EXAMPLE EMBODIMENT 6

Next, a test of the effectiveness of a structure built wherein the bottom surface of said object jigs have a circular or oval shape to enable uniform microwave heating, for roasting and sterilization was carried out by heating 14 kg of green tea having a water content of 6%. For comparison purposes, tests were carried out using square and circular plates made of polysulfone. Taking into account the fact that the risk of burning depends on the output level of the microwave generator, the microwave output level was set at 1.5 kW. In the case of the square plate, burning of the beans located at the corner positions occurred after 30 minutes of heating. Further, temperature readings taken with a fiber thermometer at the center of the plate revealed that the temperature in the center did not even exceed 100° C. at the 30-minute mark. Thus, because the temperature of the corner portions was significantly higher than the temperature of the center portion, a sufficient level of uniform heating was not carried out in the case of a square plate. Next, heating was carried out using a circular plate. In this case, after 30 minutes of heating, the temperature measured at the center portion of the plate was 135° C. Further, when measurements were taken again immediately after the circular plate was taken out of the pressure reducing chamber, the temperature was recorded at 125° C. Further, examination revealed that an optimum roasting had been carried out throughout the entire contents held on the circular plate. Next, a microbe test carried out at the center of the square plate revealed poor results. On the other hand, microbe tests carried out for samples taken from various locations of the circular plate revealed a general live microbe count and a heat-resistant live microbe count about 300 times lower than the levels established for control purposes, which are 3.5× 105 for the general live microbe count and $1.9\times10^4$ for the heat-resistant live microbe count.

EXAMPLE EMBODIMENT 7

Next, a test of structure's effectiveness in carrying out a defrosting process was carried out on 14 kg of frozen pineapple chips loaded onto a circular plate made of polysulfone. When heating was carried out at a microwave output level of 5 kW, it was found that the 14 kg of frozen pineapple could be defrosted from −30° C. to −2° C. in under 15 minutes. Further, because a roughly uniform heating took place, the temperature measured at various locations immediately after the defrosted pineapple taken out of the pressure reducing chamber revealed only a small variation from −3° C. to 0° C. Further, only a very small amount of dripping occurred, and the defrosted pineapple was found to have a high degree of taste quality.

EXAMPLE EMBODIMENT 8

Next, using the structure described in Example Embodiments 1 and 2, a test of the effectiveness of the method described in Example Embodiment 4 was carried out by drying 3.5 kg of egg yolks. First, the egg yolks were placed in a tray or plate 13, and then drying was carried out with the top portion of the tray left in an open state, but because some of the egg yolks spilled out of the tray due to the expansion of the egg yolks that occurred during heating, a high quality drying could not be carried out. Next 3.5 kg of egg yolks were placed in the tray or plate 13, and after covering the top portion of the tray with silicon-treated paper; paper cover 19 for preventing scattering and fixing a reflective frame 17, drying was carried out. In this case, the silicon-treated paper prevented the egg yolks from spilling out, and because any egg yolks that stuck to the silicon-treated paper 19 were easily removed therefrom, a high quality drying was achieved.

EXAMPLE EMBODIMENT 9

Next, using the structure described in Example Embodiments 1 and 2, a test of the effectiveness of the method described where the solid objects are cut into smaller objects in a manner than results in waveform shaped surfaces that enable air to pass between pieces and to allow microwave radiation to uniformly reach the cut surfaces was carried out by drying 7 kg of carrots. In this regard, it should be noted that carrots have a tendency to burn very easily during drying even when a rotation-type jig is used, and it is common to accept a drying loss of about 20%. First, the carrots were cut into 5 mm-thick pieces having flat cut surfaces, and then after these pieces were stacked in a tray to a height of 30 mm, a drying process was carried out. As a result, it was found that when heating was carried out for the amount of time required to dry the stacked cut surfaces, a portion of such carrots had been burned. Next, 7 kg of carrots were cut into 5 mm-thick pieces having waveform-shaped cut surfaces using a wave form-shaped cutter, and then after these pieces were stacked in a tray to a height of 30 mm, a drying process was carried out. (See FIG. 13 and FIG. 14.) In this case because microwave radiation could reach the cut surfaces and air could cut through the cut pieces, the drying process was relatively short and high-quality dried carrots were produced.

What is claimed is:

1. An apparatus for heating objects to be dried, concentrated, defrosted, roasted or sterilized, comprising:

a pressure-reducing chamber equipped with a reduced pressure level-regulating valve;

a fixed or variable power supply;

a microwave heating device which can deliver intermittent or continuous heating;

a far infrared heating device equipped with a control panel located outside said pressure-reducing chamber to control the heating temperature of infrared radiation emitted by said far infrared heating device;

a control portion for simultaneously carrying out microwave heating and far infrared heating;

a shelf-type metal support jig placed inside the pressure-reducing chamber, a top object holding jig;

a bottom object-holding jig, and plate-shaped or tray-shaped object-holding jigs for holding the objects, stacked on the shelf-type metal support jig, having a first metal reflector plate arranged at a top portion of the shelf-type metal support jig at a prescribed distance from the top object holding jig and a second metal reflector plate arranged at a bottom portion of the shelf-type metal support jig at a prescribed distance from the bottom object-holding jig to partially or completely reflect microwave and far infrared heating to the objects.

* * * * *